United States Patent [19]

Rifkin

[11] Patent Number: 4,909,471

[45] Date of Patent: Mar. 20, 1990

[54] COMBINATION OF A LOCKABLE CONTAINER AND SECURING MEANS ON WHICH THE LOCKABLE CONTAINER CAN BE POSITIONED AND LOCKED FOR LATER RETRIEVAL

[75] Inventor: Arnold S. Rifkin, Wilkes-Barre, Pa.

[73] Assignee: A. Rifkin Company, Wilkes-Barre, Pa.

[21] Appl. No.: 370,374

[22] Filed: Jun. 22, 1989

[51] Int. Cl.[4] ..... E05B 73/00

[52] U.S. Cl. ..... 248/551; 211/4; 211/13

[58] Field of Search ..... 248/551; 211/46, 43, 211/4, 13, 71; 70/68, 59

[56] References Cited

U.S. PATENT DOCUMENTS 4,514,915 5/1985 Galetta ..... 70/68 X
4,775,052 10/1988 Moore et al. ..... 211/4

FOREIGN PATENT DOCUMENTS 278620 3/1914 Fed. Rep. of Germany ..... 70/59

*Primary Examiner*—Blair M. Johnson
*Attorney, Agent, or Firm*—Panitch Schwarze Jacobs & Nadel

[57] ABSTRACT

A combination of a lockable container and a support rack on which the lockable container can be positioned and locked for later retrieval. The lockable container includes an interior portion, an access opening and a closure member positioned thereon. The closure member has an open position permitting access to the interior portion of the container through the access opening, and a closed position where the closure member closes the access opening such that the interior of the container is not accessible. A support rack and/or securing bar is provided for lockably receiving the lockable container. A flexible, endless cable is positioned about the securing bar such that the flexible, endless cable is secured to the securing bar. The cable is further positionable within a closed through aperture between a locking member and the flexible cover member on the lockable container for securing the lockable container to the securing bar and/or support rack.

13 Claims, 2 Drawing Sheets

COMBINATION OF A LOCKABLE CONTAINER AND SECURING MEANS ON WHICH THE LOCKABLE CONTAINER CAN BE POSITIONED AND LOCKED FOR LATER RETRIEVAL

FIELD OF THE INVENTION

The invention relates to a lockable container which can be placed at a location and locked for later retrieval and, more particularly, to locking and securing a bank deposit bag to a structure for later retrieval.

BACKGROUND OF THE INVENTION

Banks for some time have provided certain customers with special deposit bags which are used to make deposits after normal banking hours. Each bag has a lockable closure member (typically a lockable zipper). The customer is also provided with a key which will open only the lock on his particular bag. The bank retains a master key or keys so that it may open the locks on the bags of all or most of its customers. Each bag is identified with a number unique to the particular customer to whom the bag is allocated by the bank.

The customer may place cash, receipts, etc. in its bag, lock the bag and place the locked bag in the bank's night deposit vault. Eventually, the bank employees open the vault, remove and empty the bags, which are then left in a pile. To retrieve his bag, a customer must usually wait while a bank employee sorts through a pile of empty bags for the bag belonging to that particular customer.

Racks for lockably storing and organizing bank deposit bags so that customers may retrieve their own (and only their own) bags after the bank employees have emptied the bags are known. Referring now to FIG. 1, such a rack 18 and bank deposit bag 10 is shown. The bank deposit bag 10 has an access opening 11 and a zipper 12. The zipper 12 has an open position permitting access to the contents of the bag 10 and a closed position (as shown in FIG. 1) wherein the zipper 12 closes the access opening 11.

The bank deposit bag 10 further includes a keeper lock 14 which can be locked to securely close the bank deposit bag. That is, the keeper lock 14 can lock or secure (as shown in FIG. 1) the zipper 12 in the closed position. The keeper lock 14 defines a readily accessible closed through aperture 16 in its locked position. When the keeper lock 14 is unlocked, the closed through aperture 16 is open (not shown).

The support rack 18 includes a base 20 which defines a bank deposit bag 10 receiving area, where the bag 10 can be placed with the keeper lock 14 in its locked position. A static rod member 22 is positioned on the support rack 18 and is sized to fit within and through the closed through aperture 16 when the keeper lock 14 is in the locked position.

In use, the bank deposit bag 10 is placed on the support rack 18 and the keeper lock 14 is moved into its locked position, with the rod member 22 positioned in the closed through aperture 16, so that the bag 10 is securely held to the support rack 18. The bank deposit bag 10 can be removed from the support rack 18 by unlocking the keeper lock 14 and moving the bank deposit bag 10 out of engagement with the rod member 22, after which the bank deposit bag 10 can be removed from the support rack 18.

The support rack 18 has disadvantages in that it cannot be used with all styles of bank deposit bags. Specifically, some bank deposit bags include a cover member positioned on the bag such that it overlaps the closed through aperture of the keeper lock. In other bank deposit bags, the cover member is the canvas material which comprises the majority of the bag. In these bags, the canvas material extends and overlaps the closed through aperture. Such bags cannot be used in connection with the support rack 18 depicted in FIG. 1 because the rod member 22 cannot access the closed through aperture 16, since the cover member overlaps the aperture 16. Consequently, a need has arisen for a securing system which can accommodate a variety of differently designed bank deposit bags.

The present invention overcomes the disadvantages in the above-described support rack by providing a flexible, endless cable securely positioned on the support rack. The cable is positionable within the closed through aperture between the keeper lock and the cover member for securing the bank deposit bag to the support rack. In fact, the cable can be positioned within the aperture of the keeper lock of any style lockable container to create a so-called one-size-fits-all system. Therefore, the present invention efficiently overcomes the problems of the prior art without incurring the prohibitive costs of redesigning the current bank deposit bags to fit existing support racks.

SUMMARY OF THE INVENTION

Briefly stated, the present invention comprises a combination of a lockable container and a securing means on which the lockable container can be positioned and locked for later retrieval. The combination comprises a lockable container including an interior portion. The lockable container has an access opening and a closure member positioned thereon. The closure member has an open position permitting access to the interior portion of the container through the access opening and a closed position where the closure member closes the access opening such that the interior of the container is not accessible. A locking member is positioned on the lockable container proximate the closure member. The locking member has a locked position for locking the closure member in the closed position and an unlocked position for allowing the closure member to move between the closed and open positions. The locking member defines a closed through aperture when the locking member is in the locked position. When the locking member is in the unlocked position, the through aperture is open. A flexible cover member is positioned on the container such that it overlaps the aperture of the locking member. Therefore, the aperture can be accessed by a flexible member. The combination further includes a securing means for lockably receiving the lockable container. A flexible, endless cable is positioned about the securing means such that the flexible, endless cable is secured to the securing means. The flexible, endless cable is further positionable within the closed through aperture between the locking member and the flexible cover member for securing the lockable container to the securing means, whereby the lockable container can be positioned proximate the securing means with the locking member in the locked position and the flexible, endless cable positioned within the closed through aperture so that the container is locked to the securing means and the container can be removed from the securing means by unlocking the locking member and moving the flexible, endless cable out of the aperture so that the container is not locked to the securing means.

BRIEF DESCRIPTION OF THE DRAWINGS

The foregoing summary, as well as the following detailed description of the preferred embodiment, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF THE PREFERRED EMBODIMENT

Figure 1:
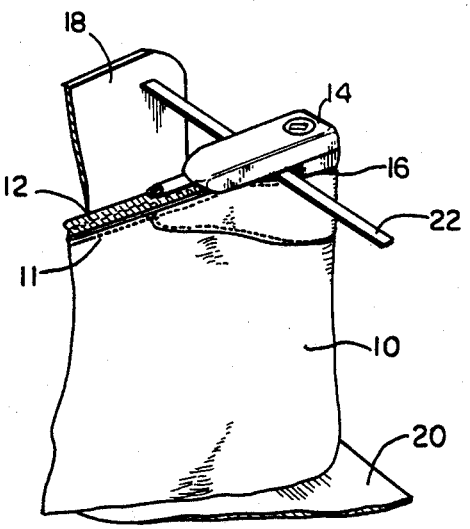
PRIOR ART FIG. 1
FIG. 1 is a partial perspective view showing a support rack and bank deposit bag in accordance with the prior art.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the lockable container and support rack and designated parts thereof. The terminology includes the words above specifically mentioned, derivatives thereof and words of similar import.

Figure 2:
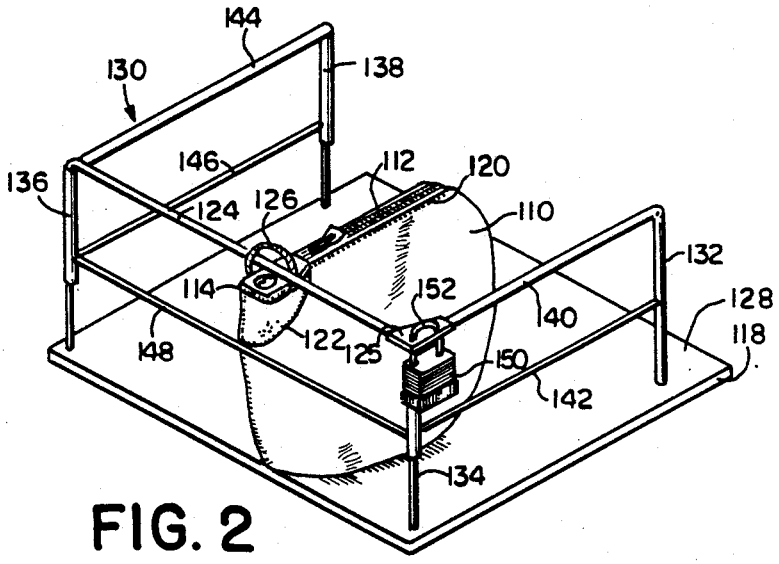
FIG. 2 is a perspective view of a lockable container secured to a support rack in accordance with the present invention.
Figure 3:
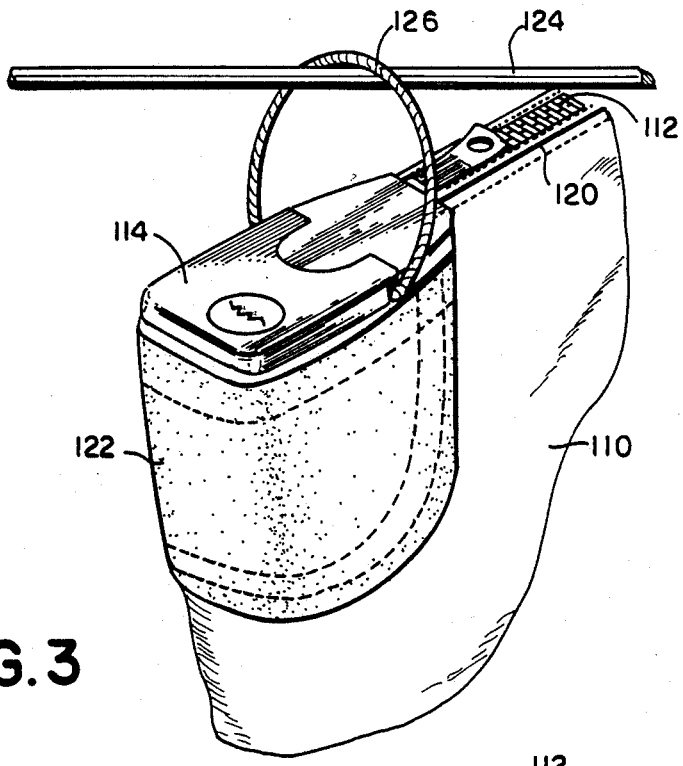
FIG. 3 is a greatly enlarged partial perspective view of the lockable container and support rack of FIG. 2.
Figure 4:
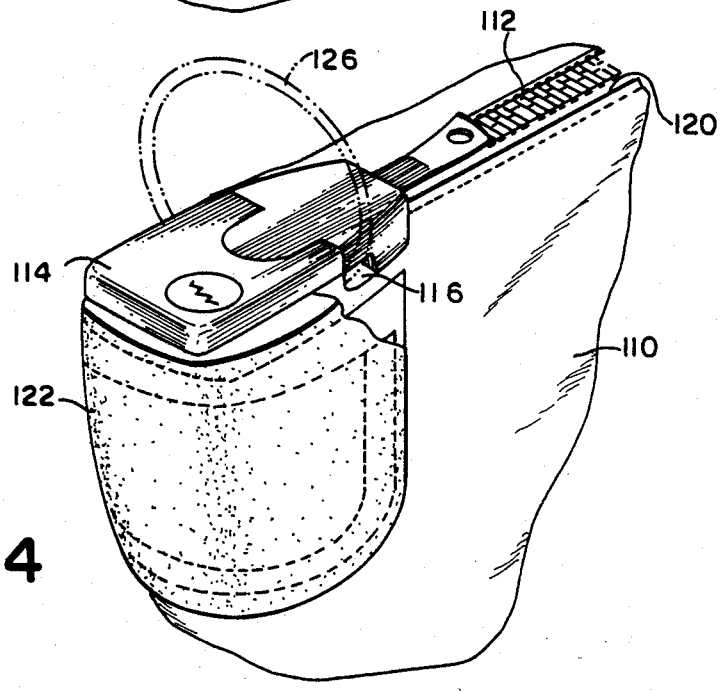
FIG. 4 is a partial sectional view of the lockable container of FIG. 3.

Referring to the drawings, wherein like numerals indicates like elements throughout, there is shown in FIGS. 2 through 4 a preferred embodiment of a combination of a lockable container and a securing means on which the lockable container can be positioned and locked for later retrieval. FIG. 2 illustrates a lockable container 110 lockably positioned on a support rack 118.

For ease of description and convenience only, the following description is directed to a single lockable container 110 in connection with a support rack 118. However, it is understood by those skilled in the art that the present invention is directed to a plurality of lockable containers in connection with a support rack.

Referring now to FIG. 2, the lockable container 110 includes an interior portion (not shown), an access opening 120 and a closure member 112 positioned thereon. The closure member 112 has an open position (not shown) permitting access to the interior portion of the lockable container 110 through the access opening 120. The closure member 112 also includes a closed position (as shown in FIG. 2) where the closure member 112 closes the access opening 120 such that the interior of the lockable container 110 is not accessible.

In the presently preferred embodiment, lockable container 110 is preferably a bank deposit bag as is known to those skilled in the art. However, as understood by those skilled in the art, the lockable container 112 can comprise other means. For instance, whereas the invention described hereinafter is applied to a container in the form of a flexible money bag, the principles of the invention are equally applicable for use with a wide variety of containers which employ keeper locks and slide fasteners for their closure, examples of such containers being duffel bags, traveling cases and other cloth containers too numerous to mention.

In the presently preferred embodiment, closure member 112 is a slide fastener of the so-called zipper type. It is understood by those skilled in the art that other means can be used for opening and closing the lockable container 110, without departing from the spirit and scope of the invention.

Referring now to FIGS. 3 and 4, a locking member 114 is positioned on the lockable container 110 proximate the closure member 112. The locking member 114 has a locked position (as shown in FIG. 3) for locking the closure member 112 in the closed position, as is understood by those skilled in the art. The locking member 114 also has an unlocked position (not shown) for allowing the closure member to move between the closed and open positions. As shown in FIG. 4, the locking member 114 defines a closed through aperture 116 when the locking member 114 is in the locked position. The through aperture 116 is open when the locking member 114 is in the unlocked position (not shown).

In the present embodiment, it is preferred that the locking member 114 be a keeper lock for a slide fastener. One example of such a keeper lock is disclosed in U.S. Pat. No. 3,785,185, which is hereby incorporated by reference. More particularly, such keeper locks have a closed or locked position wherein the lacing element (not shown) of the closure member is locked or clamped therein.

As shown in FIGS. 3 and 4, a generally flexible cover member 122 is positioned on the lockable container 110. The flexible cover member 122 overlaps the closed through aperture 116 of the locking member 114 such that the aperture 116 can be accessed by a flexible member, as described in more detail hereinafter. One incidental purpose of the flexible cover member 122 is to prevent access to the closed through aperture to thereby resist tampering or vandalism.

In the presently preferred embodiment, flexible cover member 122 is constructed of a patch or strip of leather and is secured to lockable container 110 by suitable means. For instance, cover member 122 can be sewn to lockable container 110. However, it is understood by those skilled in the art that other means may overlap the closed through aperture 116 to prevent a static member from accessing aperture 116. For instance, the material which comprises the majority of the lockable container 110 (e.g., canvas) can extend and overlap the closed through aperture 116 as described above.

Referring now to FIGS. 2 and 3, a securing means is shown for lockably receiving the lockable container 110. Preferably, the securing means is a securing bar 124 extending through a flexible, endless cable 126. More particularly, it is preferred that the securing means be a support rack 118 comprising a base member 128 and an upwardly extending support structure, generally designated 130.

In the presently preferred embodiment, base member 128 is a sheet of high strength, lightweight metallic material, such as steel. Base member 128 is generally rectangularly shaped and is of sufficient thickness to statically support four upwardly extending, generally cylindrical posts 132, 134, 136 and 138 at each corner thereof. As shown in FIG. 2, a pair of generally transversely extending support bars 140 and 142 are superimposed with respect to each other and extend between posts 132 and 134 to add structural integrity to support rack 118. Similarly, support bars 144 and 146 extend transversely between posts 136 and 138 in a like manner. Another support bar 148 similarly extends between posts 134 and 136 to also provide structural integrity to support rack 118.

Preferably, support rack 18 is constructed of a high strength, lightweight metallic material, such as steel. However, it is understood by those skilled in the art that support rack 18 can be constructed of other similar materials, such an aluminum or high strength plastic, without departing from the spirit and scope of the invention.

As shown in FIG. 2, a second locking member 150 is positioned on the securing means or support rack 118. The second locking member 150 and the securing bar 124 have a first position (shown in FIG. 2) such that the flexible, endless cable 126 is secured to the securing bar 124 and a second position (not shown) such that the flexible, endless cable 126 can be removed from the securing bar 124. Thus, the lockable container 110 can be locked to the support rack 118 when the second locking member 150 and securing bar 124 are in the first position and the lockable container 110 is not locked to the support rack 118 when the second locking member 150 and securing bar 124 are in the second position, as described in more detail hereinafter.

In the presently preferred embodiment, the second locking member 150 is a padlock and includes a conventional latching mechanism 152 for securing the securing bar 124 to the post 134 and support bar 140 (i.e., the first position), as is apparent to those skilled in the art. The securing bar 124 is pivotally connected to the post 136, in a manner known to those skilled in the art, for allowing the bar 124 to assume the second position when the second locking member 150 is unlocked.

Specifically, when the second locking member 150 is unlocked, the bar 124 can pivot away from the post 134 and thereby allow the lockable container 110 to be slidably removed therefrom (i.e., the second position). That is, the flexible endless cable 126 which is secured to the lockable container 110, can be removed from the securing bar 124 over the end 125 thereof. On the other hand, when the contents of the container 110 are emptied, they could be locked with the cable 126 within the aperture 116. Then, with the bar 124 in the second position, the container 110 can be slipped over the end 125 onto the bar 124. The bar 124 can then be locked in the first position to thereby efficiently secure the container 110 to the rack 118. When the second locking member 150 is in the first or locked position with the bar 124 lockably positioned next to post 134 and support bar 140, the lockable container 110 and the flexible, endless cable 126 are secured to the bar 124.

However, it is understood by those skilled in the art that other means could be used to lock the securing bar 124 to the post 134 and support bar 140. For instance, a combination lock could be used or a key lock could be incorporated directly into the support rack 118 structure (not shown).

As shown in FIGS. 2 and 3, the flexible, endless cable 126 is generally circular in cross section and is positioned about the securing means or bar 124 such that the flexible, endless cable 126 is secured thereto. The cross section of the flexible endless cable 126 is suitably sized to be positionable within the closed through aperture 116, between the locking member 114 and the flexible cover member 122, for securing the lockable container 110 to the securing means or bar 124. Therefore, the lockable container 110 can be positioned proximate the securing means or bar 124 with the locking member 114 in the locked position and with the flexible, endless cable 126 positioned within the closed through aperture 116 so that the lockable container 110 is locked to the securing means or bar 124. Further, the lockable container can be removed from the securing means or bar 124 by unlocking the locking member 114 and moving the flexible, endless cable 126 out of the aperture 116 so that the lockable container 110 is not locked to the securing means or bar 124.

In the presently preferred embodiment, the flexible, endless cable 126 is preferably constructed of a high strength, lightweight material, such as steel. However, it is understood by those skilled in the art that flexible, endless cable 126 can be constructed of other materials without departing from the spirit and scope of the invention. For instances, flexible, endless cable 126 can be constructed of a plurality of intertwined strands of flexible aluminum.

While the presently preferred embodiment has described the securing bar 124 used in connection with a support rack 118, it is understood by those skilled in the art that securing bar 124 can be supported in any manner or way so long as the flexible, endless cable 126 cannot be removed therefrom. For instance, bar 124 could be generally U-shaped, with the ends thereof secured to a wall, to thereby prevent the flexible, endless cable 126 from being removed therefrom.

Furthermore, while a single tier rack has been shown and disclosed, it is within the spirit and scope of the invention to have a multiple tier rack with repetitive structure for each tier. It is also understood by those skilled in the art that the lockable container 110 can be individually secured to the bar 124 without the need of a second locking member 150. Specifically, the flexible endless cable 126 can be permanently positioned on the securing bar 124, so that the lockable container 110 can only be removed by unlocking the locking member 114.

Moreover, the use of the present invention is not limited to lockable containers which include cover members which overlap the closed through aperture. The cable 126 can fit through the aperture of any keeper lock with or without a cover member overlapping the aperture. Therefore, the present invention is universal in that it is useful with all types of lockable containers which include keeper locks.

In operation, as stated previously, the securing means or bar 124 is provided for lockably receiving the lockable container 110 via the flexible, endless cable 126 which is positioned about and secured to the securing bar 124. The flexible, endless cable 126 is positioned within the closed through aperture 116 between the locking member 114 and the flexible cover member 122 to thereby secure the lockable container 110 to the securing means or bar 124.

Therefore, one or more lockable containers 110 can be placed proximate the bar 124 with the locking member 114 in the locked position having the flexible, endless cable 126 positioned within the closed through aperture 116 so that the lockable container 110 is locked to the securing bar 124. Further, the lockable container 110 can be removed from the securing bar 124 by unlocking the locking member 114 and moving the flexible, endless cable 126 out of the aperture 116 so that the lockable container 110 is not locked to the securing bar 124 for allowing the lockable container 110 to be removed from the securing bar 124.

From the foregoing description, it can be seen that the present invention comprises a lockable container which can be positioned and locked on a support rack for later retrieval and a method for accomplishing the same. It will be appreciated by those skilled in the art that changes could be made to the embodiment described above without departing from the broad inventive concept thereof. It is understood, therefore, that this invention is not limited to the particular embodiment disclosed, but it is intended to cover all modifications which are within the spirit and scope of the invention as defined by the appended claims.

I claim:

1. A combination of a lockable container and a securing means on which the lockable container can be positioned and locked for later retrieval, said combination comprising:

a lockable container including an interior portion, said lockable container having an access opening and a closure member positioned thereon, said closure member having an open position permitting access to the interior portion of said container through said access opening and a closed position where said closure member closes said access opening such that the interior of said container is not accessible;

a locking member positioned on said lockable container proximate said closure member, said locking member having a locked position for locking said closure member in said closed position and an unlocked positioned for allowing said closure member to move between said closed and open positions, said locking member defining a closed through aperture when said locking member is in said locked position and said through aperture being open when said locking member is in said unlocked position;

a flexible cover member positioned on said container, said flexible cover member overlapping said aperture of said locking member such that said aperture can be accessed by a flexible member;

a securing means for lockably receiving said lockable container; and a flexible, endless cable positioned about said securing means such that said flexible, endless cable is secured to said securing means, said flexible endless cable being further positionable within said closed through aperture between said locking member and said flexible cover member for securing said lockable container to said securing means whereby said lockable container can be positioned proximate said securing means with said locking member in said locked position and said flexible, endless cable positioned within said closed through aperture so that said container is locked to said securing means and said container can be removed from said securing means by unlocking said locking member and moving said flexible, endless cable out of said aperture so that said container is not locked to said securing means.

2. The combination as recited in claim 1 wherein said container comprises a bank bag and said closure member is a zipper.

3. The combination as recited in claim 1 wherein said securing means is a securing bar extending through said flexible, endless cable.

4. The combination as recited in claim 3 further including a second locking member positioned on said securing means, said second locking member and securing bar having a first position such that said flexible, endless cable is secured to said securing bar and a second position such that said flexible, endless cable can be removed from said securing bar, whereby said container can be locked to said securing bar when said second locking member and securing bar are in said first position and said container is not locked to said securing bar when said second locking member and securing bar are in said second position.

5. The combination as recited in claim 1 wherein said flexible cover member is constructed of leather.

6. The combination as recited in claim 1 wherein said locking member is a key-operated keeper lock.

7. The combination as recited in claim 1 wherein said flexible, endless cable is constructed of steel.

8. A combination of a lockable container and a securing means on which the lockable container can be positioned and locked for later retrieval, said combination comprising:

a lockable container including an interior portion, said lockable container having an access opening and a closure member positioned thereon, said closure member having an open position permitting access to the interior portion of said container through said access opening and a closed position where said closure member closes said access opening such that the interior of said container is not accessible;

a locking member positioned on said lockable container proximate said closure member, said locking member having a locked position for locking said closure member in said closed position and an unlocked positioned for allowing said closure member to move between said closed and open positions, said locking member defining a closed through aperture when said locking member is in said locked position and said through aperture being open when said locking member is in said unlocked position;

a securing means for lockably receiving said lockable container; and a flexible, endless cable positioned about said securing means such that said flexible, endless cable is secured to said securing means, said flexible endless cable being further positionable within said closed through aperture for securing said lockable container to said securing means whereby said lockable container can be positioned proximate said securing means with said locking member in said locked position and said flexible, endless cable positioned within said closed through aperture so that said container is locked to said securing means and said container can be removed from said securing means by unlocking said locking member and moving said flexible, endless cable out of said aperture so that said container is not locked to said securing means.

9. A method of presenting a plurality of lockable containers at a location where the containers can be placed and locked for later retrieval, wherein the lockable containers each have an interior portion, the lockable containers further having an access opening and a closure member positioned thereon, the closure member having an open position permitting access to the interior of the container through the access opening and a closed position where the closure member closes the access opening such that the interior of the container is not accessible, the lockable container further including a locking member positioned thereon proximate the closure member, the locking member having a locked position for locking the closure member in the closed position and an unlocked position for allowing the closure member to move between the closed and open positions, the locking member defining a closed through aperture when the locking member is in the locked position and the through aperture being open when the locked member is in the unlocked position, the container further including a flexible cover member position on the container, the flexible cover member overlapping the aperture of the locking member such that the aperture can be accessed by a flexible member, the method comprising:

providing a securing means for lockably receiving the lockable container and a flexible, endless cable positioned about the securing means such that the flexible, endless cable is secured to the securing means, the flexible, endless cable being further sized to fit within the closed through aperture between the locking member and the flexible cover member; and placing each lockable container proximate the securing means with the locking member in the locked position having the flexible, endless cable positioned within the closed through aperture so that the container is locked to the securing means and the container can be removed from the securing means by unlocking the locking member and moving the flexible, endless cable out of the aperture so that the container is not locked to the securing means for allowing the container to be removed from the securing means.

10. The method as recited in claim 9 further including the step of providing a bank bag as the container and a zipper for the closure member.

11. The method as recited in claim 9 further including the step of providing the securing means with a securing bar extending through the flexible, endless loop.

12. The method as recited in claim 11 further including the steps of providing the securing means with a second locking member positioned thereon, the second locking member and securing bar having a first position such that the flexible, endless cable is secured to the securing bar and a second position such that the flexible, endless cable can be removed from the securing bar, whereby the container can be locked to the securing bar when the second locking member and securing bar are in the first position and the container is not locked to the securing bar when the second locking member and securing bar are in the second position.

13. The combination as recited in claim 9 further including the step of selecting steel as the material for the flexible endless cable.

* * * * *